US008070219B2

(12) United States Patent
Walters et al.

(10) Patent No.: US 8,070,219 B2
(45) Date of Patent: Dec. 6, 2011

(54) CHAIR LEG REST ASSEMBLY

(75) Inventors: Joseph L. Walters, Goshen, IN (US); Dana E. Lockwood, Elkhart, IN (US); Robert Ripplinger, Bristol, IN (US); James A. Riegsecker, White Pigeon, IN (US)

(73) Assignee: L&P Property Management Company, South Gate, CA (US)

( * ) Notice: Subject to any disclaimer, the term of this patent is extended or adjusted under 35 U.S.C. 154(b) by 460 days.

(21) Appl. No.: 12/257,168

(22) Filed: Oct. 23, 2008

(65) Prior Publication Data

US 2010/0102612 A1 Apr. 29, 2010

(51) Int. Cl.
*A47C 1/031* (2006.01)

(52) U.S. Cl. ..... 297/85 R; 297/423.26; 297/182

(58) Field of Classification Search ..... 297/85 R, 297/423.26, 423.3, 423.38, 354.1, 354.12, 297/357

See application file for complete search history.

(56) References Cited

U.S. PATENT DOCUMENTS

| | | | | |
|---|---|---|---|---|
| 2,871,917 | A * | 2/1959 | Schliephacke | 297/85 R |
| 3,083,996 | A * | 4/1963 | Caldemeyer et al. | 297/75 |
| 3,522,925 | A * | 8/1970 | Buchtel | 248/371 |
| 3,880,462 | A * | 4/1975 | Mednick | 297/84 |
| 4,190,282 | A * | 2/1980 | Crawford | 297/68 |
| 4,318,568 | A * | 3/1982 | Ericsson | 297/354.1 |
| 4,477,118 | A | 10/1984 | Ruble | |
| 4,570,996 | A * | 2/1986 | Rogers, Jr. | 297/85 R |
| 4,660,883 | A * | 4/1987 | Kowalski | 297/85 R |
| 4,872,726 | A * | 10/1989 | White et al. | 297/367 R |
| 5,088,789 | A | 2/1992 | LaPointe et al. | |
| 5,354,116 | A * | 10/1994 | May et al. | 297/85 L |
| 5,542,746 | A | 8/1996 | Bujaryn | |
| 5,597,210 | A * | 1/1997 | Pickard | 297/423.36 |
| 5,622,410 | A * | 4/1997 | Robinson | 297/367 R |
| 5,727,848 | A | 3/1998 | Gazard | |
| 5,988,751 | A * | 11/1999 | Yoshida et al. | 297/367 R |
| 6,322,148 | B1 * | 11/2001 | Kolena et al. | 297/452.2 |
| 6,572,185 | B1 | 6/2003 | Tseng | |
| 6,634,716 | B2 | 10/2003 | Sander et al. | |
| 6,902,233 | B2 * | 6/2005 | Tseng | 297/85 R |
| 7,029,070 | B2 * | 4/2006 | Hale | 297/330 |
| 7,210,738 | B1 | 5/2007 | Mahaffy | |
| 2008/0121353 | A1 * | 5/2008 | Detmer et al. | 160/266 |

FOREIGN PATENT DOCUMENTS

WO WO 9932052 A1 * 7/1999

* cited by examiner

*Primary Examiner* — Peter Brown
*Assistant Examiner* — David E Allred
(74) *Attorney, Agent, or Firm* — Shook Hardy & Bacon LLP

(57) ABSTRACT

The present invention is related to a chair leg rest assembly or kit. The assembly or kit may include, among other things, a leg rest and a frame for extension and retraction of the leg rest. In addition, the invention may include a roller assembly connected to the leg rest for covering the frame. The invention is also related to a combination of the chair leg rest assembly or kit with a chair. In such a combination, the invention also includes a back which hingedly rotates independently from a seat.

15 Claims, 5 Drawing Sheets

CHAIR LEG REST ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to the field of chairs and more particularly to a leg rest assembly for attachment to a chair.

BACKGROUND

Leg rests are well known in chair-related arts as it is common for an individual using a chair to desire to prop his or her feet in a raised position for comfort and relaxation purposes. By raising a user's legs, he or she can effectively redistribute weight while seated, thereby relieving stress, and often times pain, at various locations of his or her body. Raising one's legs is one method of relieving lower back pain.

BRIEF SUMMARY

There is now provided and described hereinafter a leg rest assembly for attachment to a chair. In one embodiment a leg rest assembly includes a leg rest and a linkage mechanism for extension and retraction of the leg rest. A roller assembly is connected to the leg rest, and operates to cover the linkage mechanism. In another embodiment, the invention is directed to a leg rest assembly in combination with a chair. In a further embodiment, the invention is directed to a combination of a leg rest assembly with a chair, wherein the chair includes a back that rotates independently from a seat.

The present invention is designed to hide the linkage mechanism of the leg rest. As such, the invention protects a user from injury and prevents loose fabric, upholstery, and/or other objects from getting caught in the linkage mechanism. The present invention also supports a user's legs in an ergonomically desirable position.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

Embodiments of the present invention are described in detail below with reference to the attached drawing figures, wherein.

DETAILED DESCRIPTION

Figure 1:
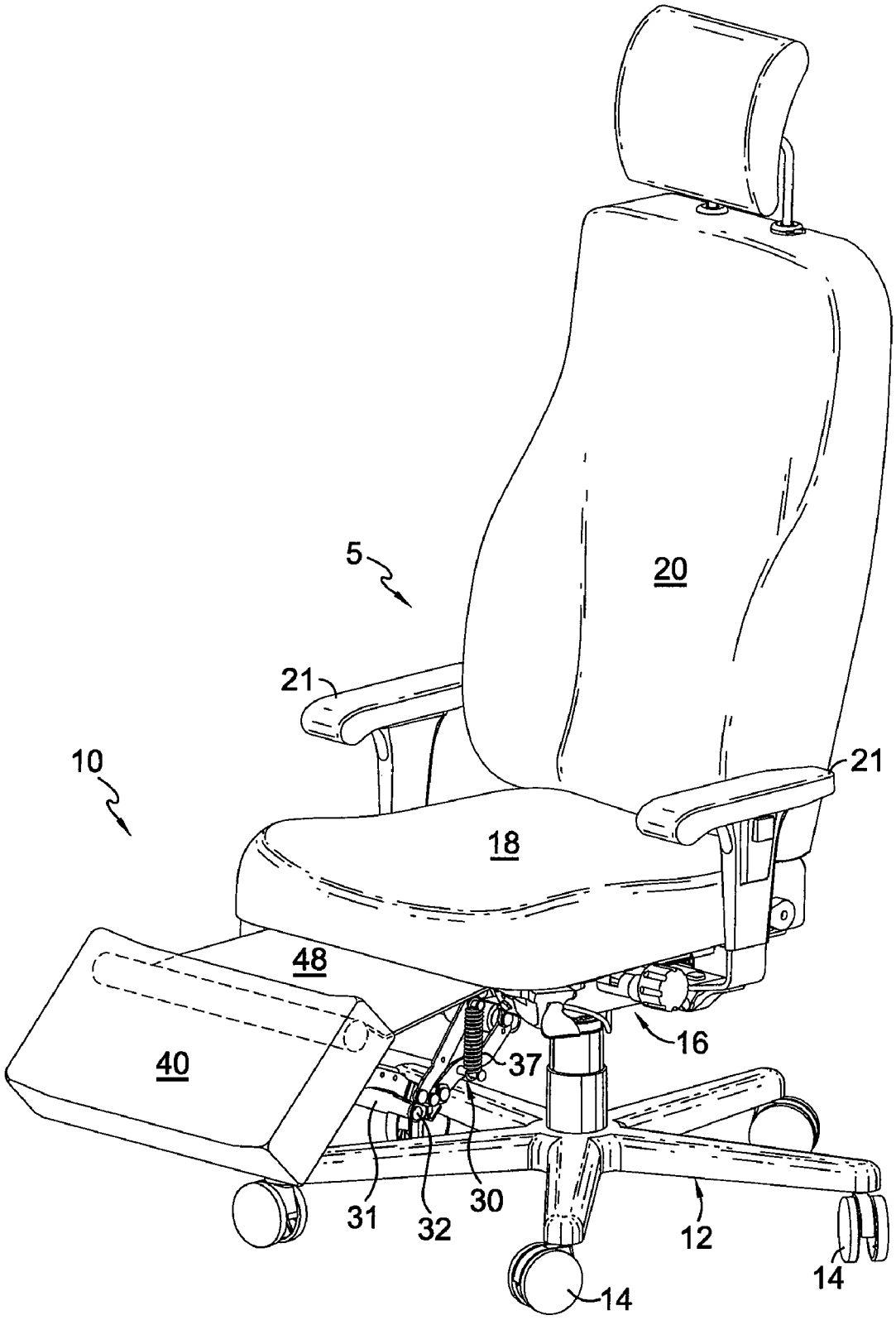
FIG. 1 is a view of a chair with a leg rest assembly attached thereto.

In a first embodiment, the invention includes a leg rest kit or assembly 10 for attachment to a chair 5. As recognized by those of skill in the art, chair 5 is an office-type chair, or task chair. It should be understood that the invention could be used on other chairs to achieve a similar effect. The chair 5 is typically equipped with a pedestal base 12 supported by rollers 14. The pedestal base supports a gas lift that supports a tilt mechanism 16, which in turn supports a chair seat 18 and back 20. The chair 5 may also be provided with a pair of arm rests 21.

Figure 5:
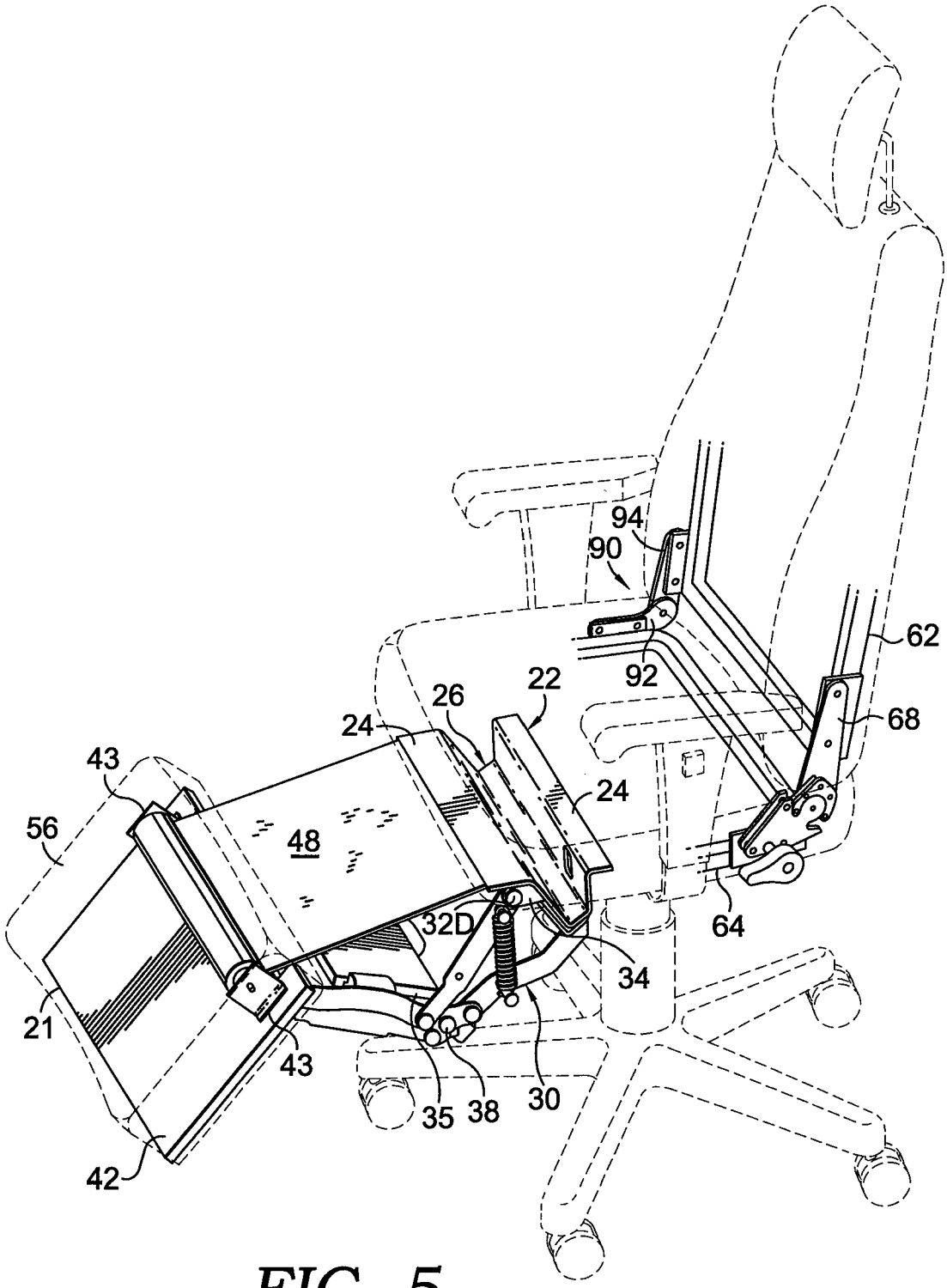
FIG. 5 is a view from above of a chair partially in ghost view to illustrate components of both a leg rest assembly and a reclining mechanism.

As best seen in FIG. 5, leg rest assembly 10 includes a mounting bracket 22. As shown, bracket 22 mounts to the underside of the seat 18 using one or more of the horizontally disposed mounting faces 24. Bracket 22 protrudes downwardly from the underside of seat 18 as shown, forming a support channel 26. Bracket 22 can be formed from any of a variety of materials, such as bent steel.

Figure 2:
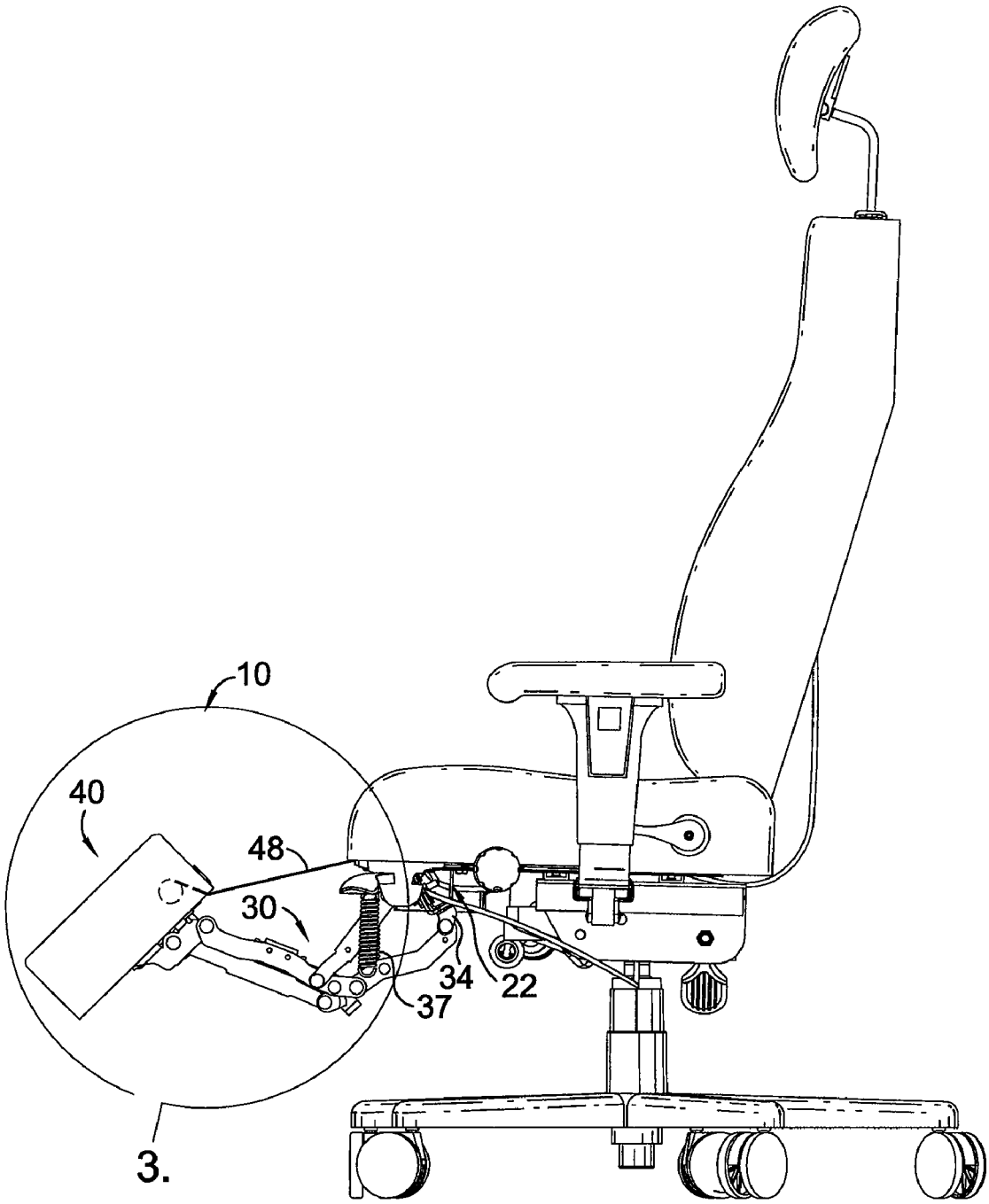
FIG. 2 is a side view of a chair with a leg rest assembly attached thereto.
Figure 3:
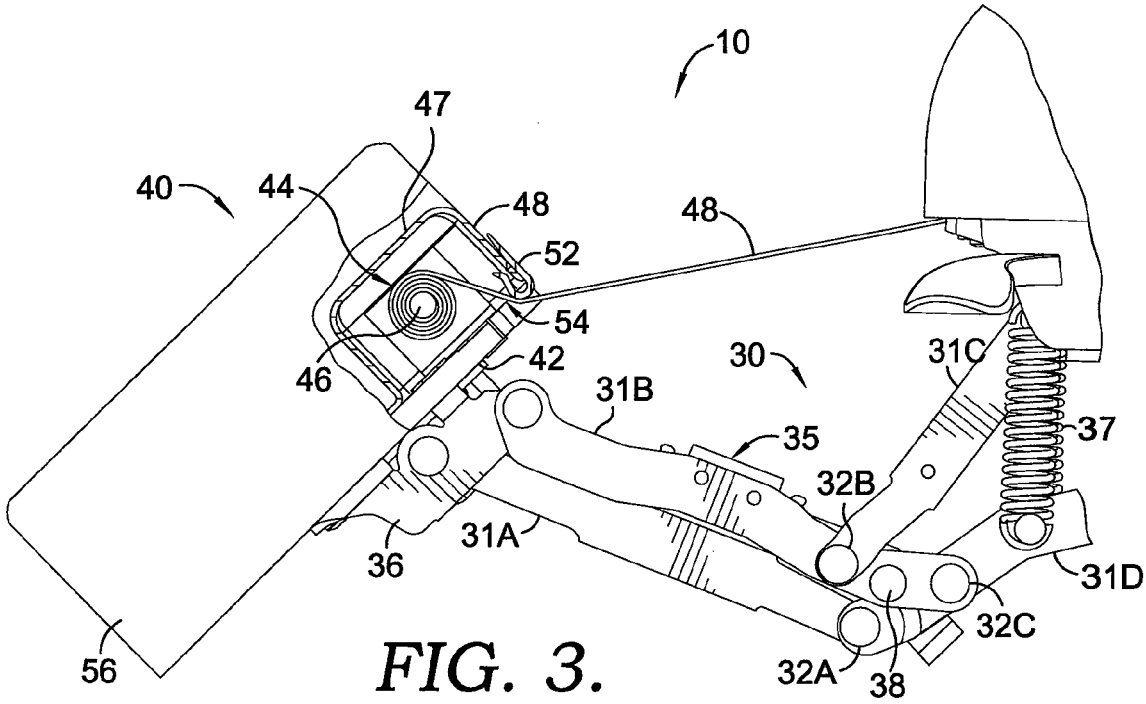
FIG. 3 is an enlarged, partial side view of a leg rest assembly, wherein a portion of a leg rest is cut out to expose a cross-section of components of a roller assembly and wherein the leg rest assembly is in an extended position.

The bottom of channel 26 provides one mounting surface for a leg rest extension linkage, shown generally as 30 in the figures. As seen in FIG. 5, other faces of bracket 22 may also provide mounting surfaces for a leg rest extension linkage 30. As known to those of skill in the art, linkage 30 includes pivotally coupled links, labeled as 31A-31D, 34, and 36 and best seen in FIGS. 2-5. Motion of linkage 30 is controlled by four bar linkages pivotally coupled together, such as links 31A-D. Further, although only one side of linkage 30 is shown and described below, it should be understood that linkage 30 includes both left and right linkages (one on each side). Links 31C and 31D are pivotally coupled to the fixed link 34, which in turn is mounted to support channel 26, as seen in FIGS. 2, 3, and 5. Link 31D is pivotally coupled to link 31B at pivot 32C, and is pivotally coupled to link 31A at pivot 32A. As best seen in FIG. 5, link 31C is pivotally supported on the upper end by link 34 at pivot point 32D. The lower end of link 31C is pivotally coupled to link 31B at pivot 32B. An extension spring 37 couples links 31C and 31D and operates to assist in extending or opening linkage 30. As stated above, link 31A is pivotally coupled on one end to link 31D at pivot point 32A. The other end of link 31A is pivotally coupled to an ottoman bracket 36. Link 31B is pivotally coupled at one end to link 31D at pivot 32C. The other end of link 31B is pivotally coupled to ottoman bracket 36. As best seen in FIG. 3, link 31B is also pivotally coupled to link 31C at pivot 32B. Link 31B is also provided a stop 38 that extends outwardly and abuts link 31C when the linkage 30 is in a fully extended position. Links 31B support a mid-ottoman 35.

Figure 4:
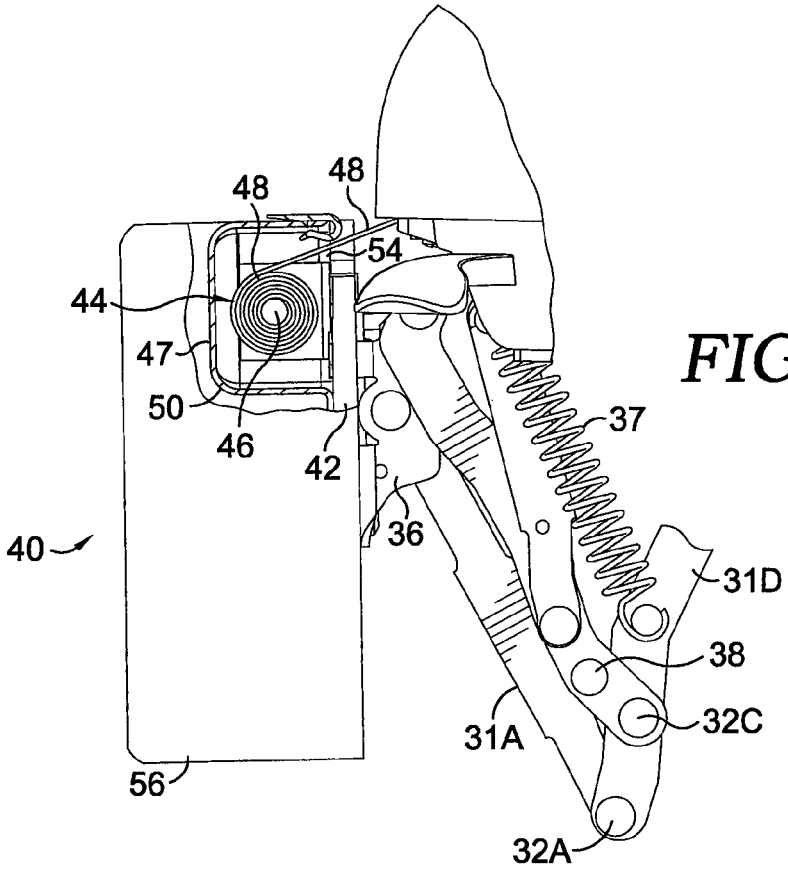
FIG. 4 is a side view similar to FIG. 3, but with the leg rest assembly in a retracted position.

As stated above, linkage 30 is coupled on its outward end to a bracket 36. Bracket 36 is, in turn, rigidly coupled to a leg rest 40. More specifically, bracket 36 is coupled to a support plate 42 that forms a part of leg rest 40. Support plate 42 is generally shaped to correspond to the desired overall shape of the leg rest 40. Plate 42 provides support and an attachment platform for a roller mechanism 44. Roller mechanism 44 includes left and right mounting arms 43 that are rigidly coupled to plate 42. A spring-loaded roller 46 extends between the mounting arms 43. As best seen in FIGS. 3 and 4, a flexible material 48 has one end secured to roller 46, with the majority of the remainder wound around roller 46 when the extension linkage 30 is in the closed position (FIG. 4). A housing cover 50 surrounds roller 44 and provides a protective cavity for both the roller 44 and the material 48. Cover 50 is preferably provided with a smooth guide 52 to protect the material 48 as it enters and exits the cavity. With continued reference to FIGS. 3 and 4, the opening 54 through which material 48 passes is seen. The opening 54 can be formed directly in plate 42, or can be formed on one side by the terminal end of plate 42, and on the other side by guide 52. The leg rest 40 also includes a surrounding cushioning material 56.

As best seen in FIG. 5, an opposite terminal end of material 48 is coupled to the chair seat, and preferably to bracket 22. In use, roller mechanism 44 operates to retract and store material 48 when the linkage 30 is in the closed position, as seen in FIG. 4. As the linkage 30 extends, the roller mechanism allows the material 48 to unwind, generally providing a covering surface above linkage 30. The tension in roller mechanism 44 is set to ensure material 48 remains taut in the extended position. When the leg rest 40 is returned to the closed position, roller mechanism 44 retracts and again stores the material 48. While not shown, it should be understood that any of a number of known release mechanisms can be used to allow extension linkage 30 to open.

Figure 6:
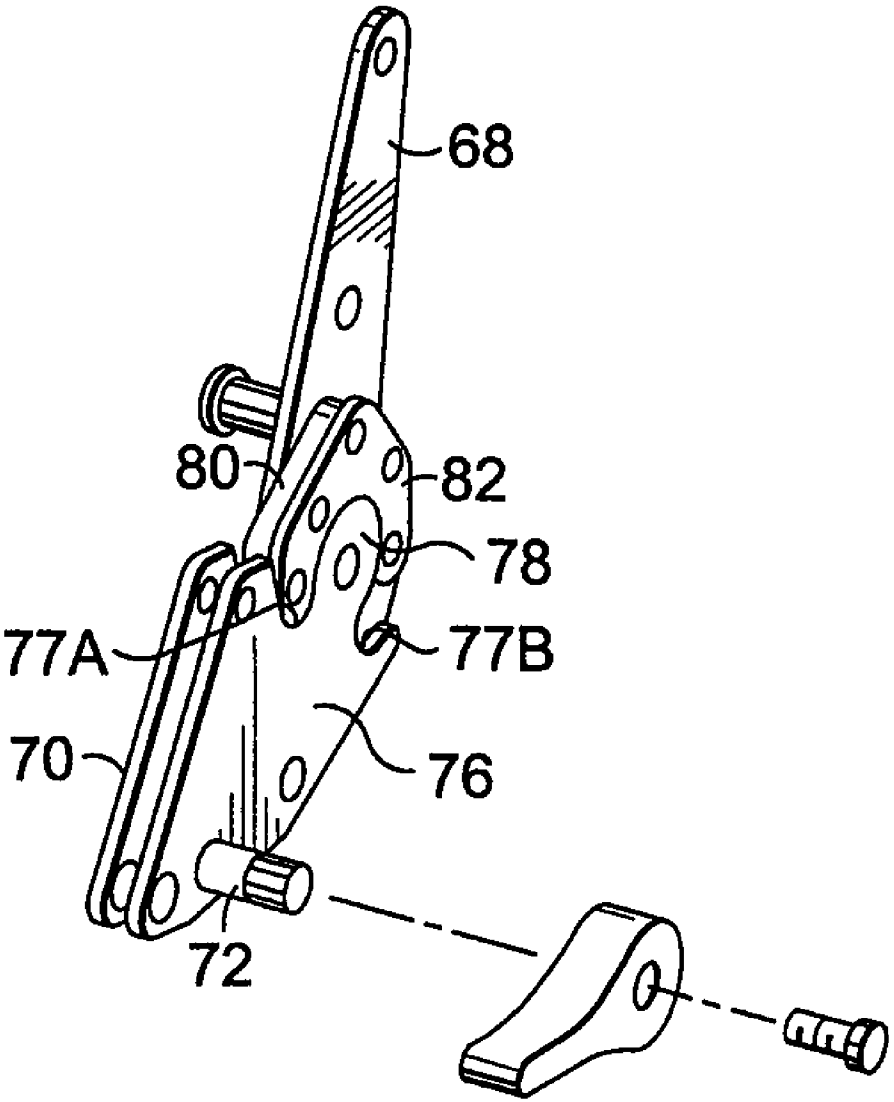
FIG. 6 is a partially exploded view of a reclining mechanism for independently reclining a back.

As best seen in FIGS. 5 and 6, the chair may include additional components that hingedly couple the back 20 to the seat 18. For example, as shown in FIG. 5, the chair may include a hinge plate 90. The hinge plate includes a seat-mounted plate 92 and a back-mounted plate 94. The seat-mounted plate 92 and back-mounted plate 94 are pivotally connected. In addition, the chair may include a reclining mechanism to control the degree at which the back 20 reclines in relation to the seat 18. The recline mechanism includes a top support plate 68 for coupling the recline mechanism to the back 20. As can be seen in FIG. 5, the top support plate 68 may be coupled to a frame 62 of the back 20. As can be seen in FIG. 6, fixed to an outside surface of the top support plate 68 is a top gear 80. Furthermore attached to the top gear 80 is a c-shaped plate 82. As can best be seen in FIG. 6, a portion of the top gear 80 is coupled between the top support plate 68 and the c-shaped plate 82. In addition, although hidden from view in FIG. 6, an alternative portion of the top gear 80 extends between an outside plate 76 and an inside plate 70.

The outside plate 76 includes a rounded extension 78. As can be seen best in FIG. 6, the rounded extension 78 creates two recesses 77A and 77B in the outside plate 76, the function of which will be further explained below. The outside plate 76 is coupled to the top gear 80. The outside plate 76 is also fixed to the seat 18 of the chair 5. For example, as can be seen in FIG. 5, the outside plate 76 may be fixed to a frame 64 of the seat 18. Extending through the outside plate 76 is a rotatable shaft 72. The recline assembly also includes an inside plate 70 coupled near parallel to the outside plate 76 and in between the seat and the outside plate 76. As can be seen in FIG. 6, a cavity is created between the outside plate 76 and inside plate 70. The rotatable shaft 72 extends through the outside plate 76 and into the cavity. Although hidden from view, coupled to the rotatable shaft 72, in between the outside plate 76 and inside plate 70, are one or more teeth. The one or more teeth are operably coupled to the rotatable shaft 72 such that when the shaft 72 is rotated, the one or more teeth change positions in between the outside plate 76 and inside plate 70.

As previously mentioned the outside plate 76 is rotatably coupled to at least the top gear 80. For example, a bolt may extend through the rounded extension 78 and serve as an axis on which the top gear 80 rotates. Furthermore, the outside plate 76 is coupled to the top gear 80 such that the outside plate 76 and c-shaped plate 82 are oriented in the same plane, and the rounded extension 78 fits in the middle of the c-shaped plate 82. Accordingly, when the top gear 80 rotates on an axis, ends of the c-shaped plate 82 function to stop rotation when the ends come into contact with recesses 77A and 77B of the outside plate 76. The previously described one or more teeth function to engage the top gear to prevent the top gear from rotating. When the teeth change position, such as by rotation of the shaft 72, the top gear 80 and teeth may become disengaged, and the top gear 80 may rotate. Rotation of the top gear 80 in turn rotates both the top support plate 68, connected to the back frame 62, and the c-shaped plate 82. As previously explained, the c-shaped plate 82 limits the range of rotation where the ends of the c-shaped plate 82 come into contact with recesses 77A and 77B of the outside plate 76.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A leg-rest assembly for attachment to a chair having a base and a seat, the leg-rest assembly comprising:

(a) a leg rest including a support plate;

(b) a linkage mechanism coupled directly to a bottom side of the support plate, the linkage mechanism operable to move between a retracted position and an extended position;

(c) a roller coupled directly to a top side of the support plate, wherein the top side is opposite the bottom side; and (d) material coupled at one edge to the roller, which rotates to wind the material about the roller, wherein the material unrolls from the roller to provide a cover above the linkage mechanism.

2. The leg-rest assembly of claim 1 further comprising, a mounting bracket for attaching the linkage mechanism to the seat.

3. The leg-rest assembly of claim 2, wherein the mounting bracket comprises two or more mounting faces.

4. The leg-rest assembly of claim 1, wherein the linkage mechanism comprises pivotally-coupled links.

5. The leg-rest assembly of claim 1, wherein the roller is coupled between a left mounting arm and a right mounting arm and wherein the left mounting arm and the right mounting arm are coupled to the top side of the support plate.

6. The leg-rest assembly of claim 5, wherein the roller comprises: a spring-loaded roller coupled between the left mounting arm and right mounting arm, and wherein the material winds around the spring-loaded roller.

7. The leg-rest assembly of claim 1 further comprising, a housing cover attached to the top side of the support plate, wherein the housing cover at-least partially surrounds the roller.

8. A chair comprising:

(a) a base assembly;

(b) a seat coupled to the base assembly; and (c) a leg-rest assembly coupled to the seat, the leg-rest assembly including:

a mounting bracket that attaches to an underneath side of the seat, wherein the mounting bracket includes horizontally disposed mounting faces;

a pair of linkages coupled at respective first ends to the mounting bracket, wherein the horizontally disposed mounting faces extend between the pair of linkages and wherein the pair of linkages move between a retracted position and an extended position;

a leg rest that includes a support plate and that is attached to respective second ends of the pair of linkages, wherein the respective second ends of the pair of linkages attach to a bottom side of the support plate;

a roller coupled directly to a top side of the support plate that is opposite the bottom side; and material coupled at one edge to the roller, which rotates to wind the material about the roller, wherein the material unrolls from the roller to provide a cover above the pair of linkages.

9. The chair of claim 8, wherein each linkage of the pair of linkages comprises a respective set of pivotally-coupled links.

10. The chair of claim 8, wherein mounting arms are coupled to the top side of the support plate and wherein the roller is rotatably coupled between the mounting arms.

11. The chair of claim 10, wherein the roller comprises a spring-loaded roller and wherein the material is wound around the spring-loaded roller.

12. The chair of claim 8 further comprising, a housing cover attached to the top side of the support plate, wherein the housing cover at-least partially surrounds the roller.

13. The chair of claim 8 further comprising, a back hingedly coupled to the seat, wherein the back rotates independently from the seat.

14. The chair of claim 13 further comprising, a recline mechanism coupled to one side of the chair, wherein the recline mechanism comprises:

a first plate coupled to the back and a second plate coupled to the seat, wherein the first plate and the second plate are coupled in the same plane and wherein the second plate is shaped to receive portions of the first plate when the back rotates.

15. A chair comprising:

a base assembly;

a seat coupled to the base assembly;

a leg-rest assembly coupled to the seat, the leg-rest assembly including:

a linkage mechanism coupled to an underneath side of the seat, the linkage mechanism movable between a retracted position and an extended position;

a leg rest having a support plate that is attached to the linkage mechanism, wherein the linkage mechanism is attached to an underneath side of the support plate, and wherein the leg rest includes cushioning material that is coupled adjacent to a top side of the support plate, which is opposite the underneath side of the support plate;

a roller coupled directly to the top side of the support plate;

flexible material coupled at one edge to the roller, which rotates to wind the flexible material about the roller, wherein the flexible material unrolls from the roller to provide a cover above the linkage mechanism; and a roller cover that extends around the roller and around any flexible material wound around the roller, thereby providing a protective cavity within the cushioning material.

* * * * *